United States Patent [19]

Nilsson

[11] 4,004,537

[45] Jan. 25, 1977

[54] STEERING MECHANISM

[75] Inventor: Sven Walter Nilsson, Partille, Sweden

[73] Assignee: SKF Nova A.B., Goteborg, Sweden

[22] Filed: May 14, 1976

[21] Appl. No.: 686,539

[30] Foreign Application Priority Data

May 16, 1975 Sweden ..... 7505626

[52] U.S. Cl. ..... 114/144 R; 114/144 E; 244/83 E; 244/83 G

[51] Int. Cl.[2] ..... B63H 25/20; B63H 25/24

[58] Field of Search ..... 114/144 R, 144 A, 144 E; 244/76 A, 83 R, 83 G, 83 K, 83 E, 197; 74/625, 494; 180/79.1; 318/588

[56] References Cited

UNITED STATES PATENTS

| | | | |
|---|---|---|---|
| 2,702,615 | 2/1955 | Morse | 114/144 R |
| 3,206,998 | 9/1965 | Matz, Jr. et al. | 74/494 |
| 3,761,791 | 9/1973 | Ware | 318/588 |
| 3,811,394 | 5/1974 | Lathers | 114/144 R |

*Primary Examiner*—Trygve M. Blix
*Assistant Examiner*—Stuart M. Goldstein
*Attorney, Agent, or Firm*—Howson and Howson

[57] ABSTRACT

A manual steering wheel or the like is connected through a rotatable flexible cable and a double-acting free wheeling clutch to a rotatable element controlling the position of a steering member such as a boat's rudder. A servo motor is also connected through the clutch to the rotatable element, and starting, stopping, and the direction of operation of the motor are controlled by electric pole changing spring contacts associated with the wheel. The connection of the steering wheel to the rotatable element is directly through the free wheel element of the clutch, while the servo motor is connected to the rotatable element through the other rotary element of the clutch. This permits the servo motor normally to drive the rudder in response to steering wheel motion, but direct manual steering is enabled should the servo motor operate too slowly or not at all.

9 Claims, 6 Drawing Figures

STEERING MECHANISM

BACKGROUND OF THE INVENTION

The present invention relates to steering systems of the class in which manually-operable steering control means, with servo assistance, effect control of rotatable means to move a steering member so as to exert a steering effect. While not so limited, in one specific form it relates to servo-assisted systems for steering a boat.

It is known to provide servo assist of steering operations so as to reduce the manual power required for steering. This has been accomplished in the past by using motor means, commonly known as a servo motor, to drive rotatable means which control the motor of the steering member, and to control the starting, stopping and direction of motion of the servo motor by means of electrical spring-contacts associated with the wheel or other manually-operable steering control means. It is also known to provide direct manual steering in combination with the servo assist, for example by means of a rotatable flexible shaft coupling the steering wheel or the like to the same rotatable member as is driven by the servo motor.

However, in such a system it is possible for the servo system to breakdown in a manner which not only prevents proper servo assist, but also interferes with proper operation of the direct manual steering portion of the system. For example, if an electrical servo motor is used and the servo motor breaks down and becomes locked, it can lock the rotatable member against rotation and thus prevent direct manual steering also. All steering control is then lost.

In one known form of direct manual steering system, the rotatable member driven by the rotatable flexible shaft may comprise the nut or screw of a ball screw cylinder, i.e. a device comprising a nut, a screw which is rotatable relative to the nut, and a number of balls arranged between the nut and the screw in a closed loop. Rotation of the nut or screw is converted to linear motion of an output member which operates the rudder or other steering member. Such a ball screw cylinder device is disclosed, for example in Ser. No. 661,812 of Andersson. It is known to use such ball screw cylinders in steering systems using hydraulic servo assist mechanisms, but such hydraulic systems have required special piston and valve arrangements operated by the steering wheel or other steering control means, and normal ball screw cylinders have not been readily usable in such applications. Hydraulic servo assisted steering systems are therefore relatively complicated and expensive.

It is also known to drive a conventional, relatively inexpensive ball screw device with an electric motor, particularly with the ball screw directly actuated by the motor, as in devices for maneuvering aircraft landing gear or wing flaps, for example.

It is an object of the invention to provide a new and useful servo assisted steering system in which manual steerability is retained in the event of breakdown of the servo assist portion of the system.

Another object is to provide such system in which the servo motor is an electric motor and, preferably, both the motor and the manually-operable steering control means drive a conventional ball screw device to move the steering member.

Still another object is to provide such a steering system which is readily combinable with an additional manually-operable steering control means and/or with automatic steering apparatus.

SUMMARY OF THE INVENTION

In accordance with the invention, these and other objects are achieved by the provision of an improvement in steering systems of the class comprising a steering member movable to exert a steering effect, rotatable means responsive to rotation thereof for moving said steering member to produce said steering effect, and manually-operable steering control means for effecting control of the rotation of said rotatable means in response to changes in the position of said steering control means, said improvement comprising: motor means; double-acting free-wheeling clutch means; said clutch means comprising primary drive means, free wheel means, and releasable coupling means for rendering said primary drive means responsive to rotational drive applied thereto in either direction to rotate said free wheel means, and for rendering said free wheel means rotatable substantially free of said primary drive means in either direction with respect to said primary drive means; means connecting said free wheel means to said manually-operable steering control means and to said rotatable means to provide a direct rotational connection between them; and means connecting said motor means to said primary drive means to drive it in rotation when said motor means is operating; whereby both said motor means and said manually-operable steering control means are drivingly connected to said rotatable means except at times when said free wheel means is rotated with respect to said primary drive means, said steering conrol means at said times being operable to drive said rotatable means substantially independently of said motor means.

Preferably said rotatable means comprises screw-threaded means, such as a ball screw arrangement, associated with a linearly-movable element so as to move said element linearly in response to rotation of the screw-threaded means, and the means connecting the manually-operable steering control means to the free wheel means preferably comprises a rotatable flexible shaft. The motor means preferably comprise an electric motor, the starting, stopping and direction of motion of which are controlled by the manually-operable steering control means, preferably by means of electric pole changing spring contact means associated with the steering control means and connected to said motor. In certain preferred embodiments there are employed additional manually-operable steering control means and connections thereto for controlling the motor to enable steering from another position and, preferably, switch means for enabling connection and disconnection of the additional steering control means to and from the systems. A preferred embodiment also comprises automatic steering apparatus operatively connectable to the motor means for controlling the steering, preferably with means for disconnecting the manually-operable steering control means from the clutch means when the automatic steering apparatus is in use.

BRIEF DESCRIPTION OF FIGURES

These and other objects and features of the invention will be more readily understood from a consideration of the following detailed description taken with the accompanying drawings in which.

DESCRIPTION OF SPECIFIC EMBODIMENTS

Figure 1:
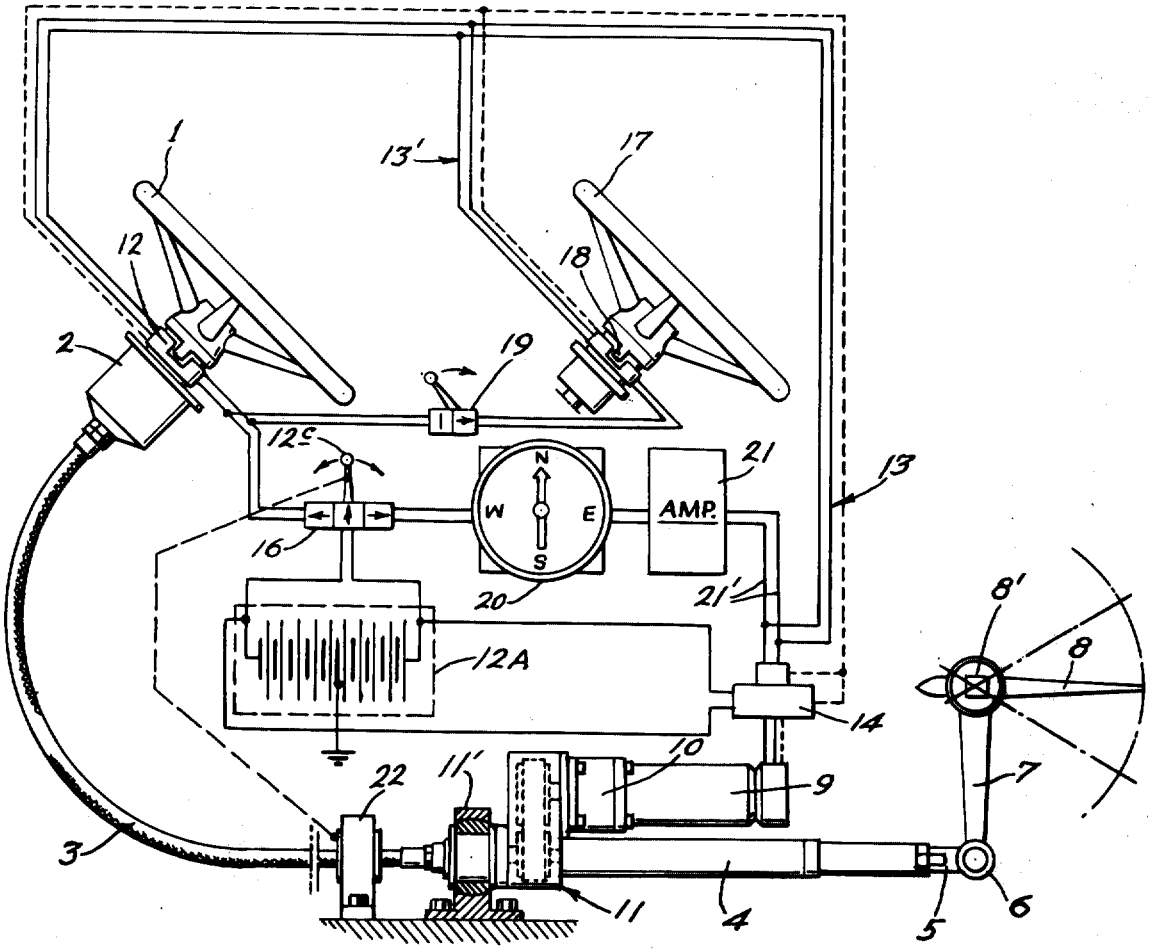
FIG. 1 is a diagrammatic representation of a steering system according to the invention.
Figure 2:
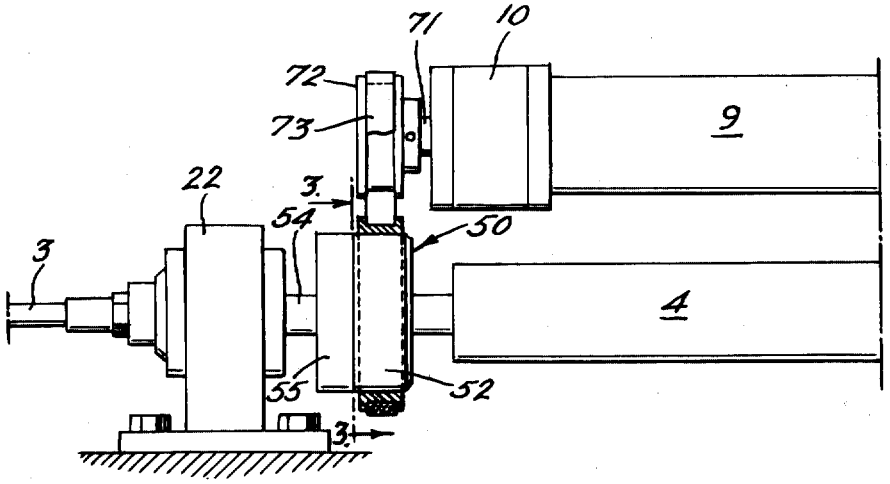
FIG. 2 is a side view of a portion of the system of FIG. 1, showing especially the servo motor, the clutch, the ball screw cylinder, and connections to and among them.

Referring now to the embodiment of the invention illustrated in the Figures by way of example only, and which will be described for convenience in an application to control of a boat's rudder by a steering wheel, there is shown manually-operable steering control means in the form of a principal steering wheel 1, together with a suitable gear device 2 for appropriately stepping up the rotary motion of the steering wheel to drive the rotatable flexible shaft in cable 3 at an appropriate rate. The torque transmitted through cable 3 is transmitted to a rotatable member in a ball screw cylinder 4 through elements to be described hereinafter. The rotatable member can be the screw or the nut in the ball screw cylinder, and in any event the rotational motion of the rotatable member in the ball screw cylinder is transformed in known manner into linear motion of a bar 5. Motion of bar 5 is transmitted by way of pivot link 6 and arm 7 to steering member 8, which may be the boat's rudder and is rigidly connected to arm 7 and pivoted about pivot 8'. Manual rotation of wheel 1 can therefore act through direct mechanical connections to control the angular position of rudder 8 and thus control steering of the boat.

The rotatable element in the ball screw cylinder is also connected to an electrical servo motor 9, by way of suitable gear assembly 10 and a transmission 11. The transmission 11 also serves to transmit the torque from the flexible shaft in cable 3 to the rotatable member, the rotatable bearing support 11' serving to transmit the torque from the flexible shaft to transmission 11.

Transmission 11 serves the function of permitting driving of the rotatable member in the ball screw cylinder by the servo motor during normal servo operation; however, when the flexible shaft tends to rotate the rotatable member at a higher rate than the servo motor can then provide, the servo motor output is effectively decoupled from the rotatable member and the driving connection to the rotatable member is solely from the rotatable shaft in cable 3. Accordingly, should the servo motor be running too slowly or stop due to a failure in the servo system, or should it be desired to turn the rotatable member faster than the servo motor can provide, the rotatabe shaft assumes control of the rotation of the rotatable member independently of the servo motor. Manual steerability is therefore retained in the event of failure of the servo system, and if a greater rate of steering is required than the servo motor can provide, the system can effect this also.

Transmission 11 may comprise a double-acting free wheeling clutch means, an example of which is shown in the other figures herein, and will be described hereinafter. Such clutch means has free wheel means which is connected drivingly between the rotatable flexible shaft and the rotatable member in the ball screw cylinder; it also comprises primary drive means which is connected drivingly to the free wheel member only so long as it rotates at least as fast as the free wheel means. When the free wheel means moves faster than the primary drive member in either direction, the primary drive means is effectively decoupled from the free wheel means, so that the latter drives the rotatable member in the ball screw cylinder substantially independently of the primary drive means and of the servo motor, as desired. There are a variety of clutch means known in the art for providing such function, and the particular form thereof to be described hereinafter with reference to the other figures is therefore by way of example only.

Control of the starting and stopping of the servo motor and of its direction of rotation are provided by a wheel torque sensing arrangement in the form of electric pole changing spring contact device 12 associated with the steering wheel 1. Such arrangements are known in the prior art, and may comprise a spring-loaded contact arrangement acting in effect between the steering wheel and the steering shaft, so that when the steering wheel is under zero torque none of the contacts are closed, when it is subjected to more than a predetermined torque in one direction one of the contacts will be closed, and when it is subjected to more than a predetermined torque in the opposite direction the other contact will be closed. A source 12A of electric potential, such as a battery, is connectable through a switch 16 to the device 12 so that one of its contacts is positive to ground and the other negative to ground, a center-tap of the battery 12A preferably also being connected to ground. Switch 16 in this example is a three-position switch, and it is when its control arm 12C is thrown to its left-hand position that battery potential is supplied as described above to the device 12.

Wires 13 from device 12 extend to a relay device 14, which may be in the nature of an electrically-controlled double-pole reversing switch which changes its position depending upon whether it is receiving voltage of positive or negative polarity from one or the other of the two wires of 13 shown in solid line, and which assumes a neutral position if neither of these two wires is supplied with voltage. The dashed line in the drawing of wires 13 represents a ground line. Voltage from 14. the battery 12A is also supplied to relay device 14, Depending upon the direction of torque, if any, applied to the steering wheel 1, as reflected in the voltages supplied over cable 13, relay device 14 supplies motor 9 with the corresponding polarity of operating voltage from battery 12A, or with no voltage if there is no torque or only a small torque on wheel 1.

More particularly, if the steering wheel 1 is not turned, no current will be supplied to the motor 9 and the steering member 8 will not be affected. So long as the wheel 1 is urged sufficiently strongly in one direction, current will be supplied to motor 9 in the direction to move steering member 8 in the desired steering direction, and if the wheel is turned in the opposite direction the current to motor 9 reverses and moves the steering member 8 in the opposite direction. The servo motor is then not only doing most of the actual steering work, but also drives the flexible shaft in cable 3 to turn the wheel hub; this provides a feedback connection so that when turning of the wheel is stopped, the wheel hub will rotate sufficiently to disconnect the spring contacts and arrest further motion of the steering member 8, as desired.

If during a steering operation one finds that the steering resulting from the servo action is too slow, applying an increased steering torque to wheel 1 will apply mechanical torque directly from the steering wheel to the rotatable member in the ball screw cylinder, thus to some degree reducing the load on the servo motor which accordingly rotates faster, and the desired more rapid steering is effected. When the torque on the steering wheel exceeds a predetermined level, the free wheel and the clutch will be moved by the rotatable shaft at a higher speed than the motor 9 can match, and at such time the coupling between the free wheel in the clutch and the primary drive means connected to motor 9 is eliminated, the free wheel moves substantially independently of the motor, and the steering is completely manual, with the speed of steering determined by the torque applied to the steering wheel.

In the neutral position of switch 16, no voltage is applied to device 12, the relay 14 remains in its neutral position, and no current is applied to the motor 9. Under these conditions, steering is completely manual, by way of the free wheel in the transmission 11. The same operation occurs if for any reason the current to motor 9 fails, even when the switch 16 is in the position intended to supply current to the motor.

In the embodiment shown, a second or additional steering wheel 17 is provided to permit steering at a separate location on the boat. Wheel 17 is provided with a contact device 18 like the contact device of wheel 1, and is provided with three wires 13' connected respectively with the corresponding wires 13. Voltage for operating device 18 is supplied from battery 12A by way of switch 16 and an additional switch 19, which can be moved to its open position when it is desired to disconnect the additional steering wheel 17 from the system. When wheel 17 and its associated electrical system is connected in the system, the wheel 17 may be used alternatively to wheel 1 in accomplishing servo controlled steering. However, in this example direct manual steering cannot be accomplished by wheel 17.

Preferably also, the system may include an automatic steering apparatus comprising a signal transmitting compass 20 and a suitable signal amplifier 21, the output wires 21' of which are also connected to control the operation of the relay device 14. Switch 16 is provided with a right-hand position in which voltage from battery 12A is provided to the automatic steering system rather than to either of the wheel systems when automatic steering is desired. With the system as thus far described, operation of the automatic steering system will also tend to turn the steering wheel 1 by way of the free wheel and the flexible shaft in cable 3. To avoid this, the system may be provided with a suitable clutch 22 inserted in the cable 3 and automatically opened when switch 16 is thrown to the position for automatic steering.

Referring now to the FIGS. 2–6, in which parts corresponding to those of FIG. 1 are indicated by corresponding numerals, the transmission 11 in this example is a known-type of double-acting free-wheeling clutch means 50. It includes primary drive means comprising an outer ring 52 and free wheel means comprising shaft 54, shaft flange 55 secured to shaft 54, and clutch release pins 56, which move as a unit. The coupling means between the ring 52 and the shaft 54 comprises the pair of rollers 60, 63 urged apart by a coil spring 64 so that the rollers are normally jammed between the inner surface of ring 52 and the outer surface of a cam member 66 mounted to turn freely on shaft 54, and lost motion drive pins 68 secured to the cam member 66 and extending into openings 70 in shaft flange 55. Openings 70 are larger in diameter than the lost motion pins 68, so that an appreciable amount of relative rotation is possible between the cam member and the shaft flange 55.

Figure 3:
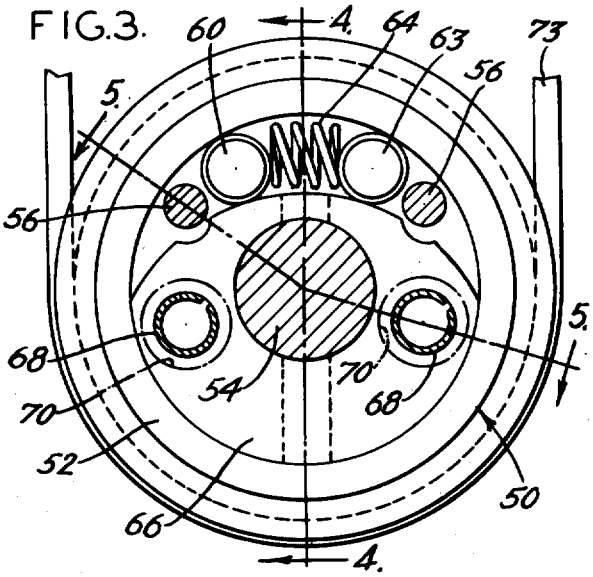
FIG. 3 is a sectional view of the clutch of FIG. 2 when the system is at rest or being driven by the servo motor, and taken along lines 3—3 of FIG. 2.
Figure 6:
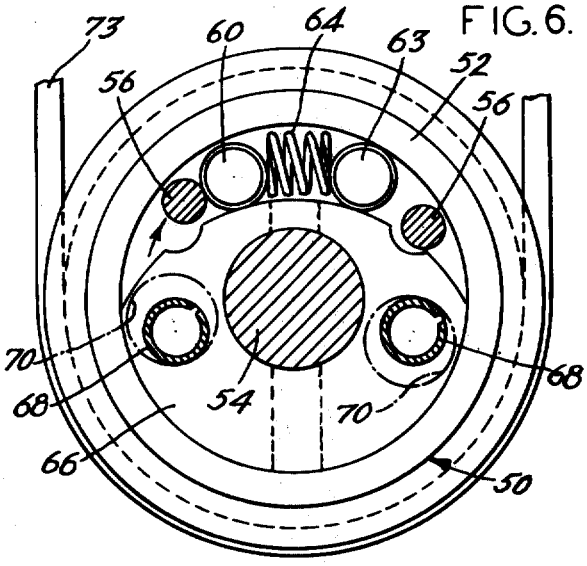
FIG. 6 is a sectional view like that of FIG. 3, but showing the clutch as it appears when the rotatable flexible shaft is rotating and the servo motor is stopped.
Figure 4:
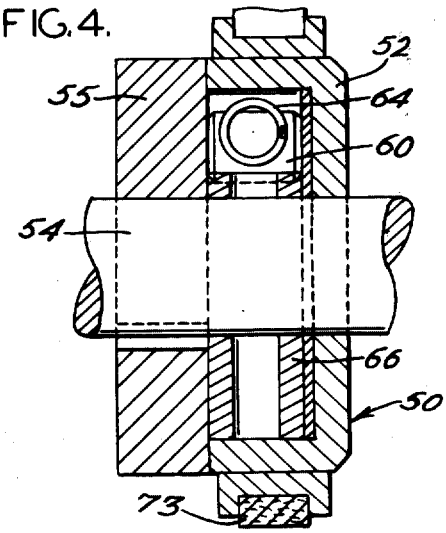
FIG. 4 is a sectional view taken along lines 4—4 of FIG. 3.
Figure 5:
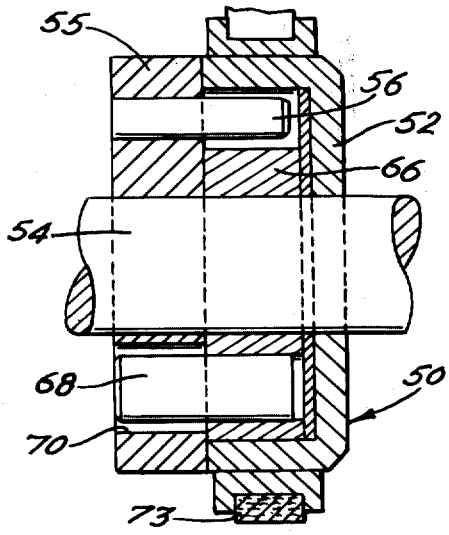
FIG. 5 is a sectional view taken along lines 5—5 of FIG. 3.

In operation of the clutch means of FIGS. 2–5, the entire system when arrested appears as in FIG. 3, in which the spring 64 jams both rollers between the cam surface and the inner surface of the ring 52. When the steering wheel is turned to actuate the servo motor, the outer ring 52 is thereby driven by the drive shaft 71 of motor 9 and through the pulley 72 and belt 73. This drive is transferred through the spring and roller arrangement to the cam, and thence through the lost motion pins 68 to shaft flange 55 and the shaft 54, as desired for normal operation. If some additional torque is applied to the steering wheel in an effort to speed up steering, up to a certain level of such torque this serves to relieve the load on the servo motor, which can then speed up and the desired faster steering action is obtained. However, when the wheel torque exceeds a certain level, either due to a desired extremely fast steering or because of drag or jamming of the motor 9, the shaft 54 and shaft flange 55 will at least momentarily turn faster than the ring 52, producing a relative angular shift between the shaft flange 55 and the assembly of cam, rollers and spring, as illustrated for example in FIG. 6. This shift is permitted by the lost motion action provided by the openings 70 of larger diameter than the pins 68, and enables the left-hand pin 56 in FIG. 6 to urge left-hand roller 60 clockwise in the example illustrated, against the pressure of spring 64, so as to release the roller from its jammed position between the cam and the ring 52. It is noted in this connection that the cam surface is such as to provide a spacing between the cam surface and the inner surface of the ring 52 which increases in the direction toward the center of spring 64 from either side thereof, so that the above-described movement of the roller by the pin 56 causes the roller to reach a position where said spacing is greater than the diameter of the roller. For this same assumed direction of rotation of shaft 54, the roller 63 is also free to move, and the clutch mechanism is thereby released to permit the shaft 54 and elements secured thereto to turn in a free wheeling condition, substantially independent of the ring 52 and the elements of motor 9 connected to it. An analogous operation occurs for the opposite direction of rotation of the steering wheel. Such clutch devices being well known, no further description of their structure and operation is believed necessary.

It will be understood that the invention has been described with particular reference to specific embodiments only in the interest of complete definiteness, and that the invention may take other forms diverse from those specifically shown and described. By way of example only, the servo motor need not be an electric motor, and the rotatable element which is driven by motion of the steering wheel need not be a part of the ball screw device, although this is preferred, because of its small friction losses. The invention is applicable to many different uses, including for example the steering of automotive land vehicles. Accordingly, the invention is limited only by the appended claims.

What is claimed is:

1. In a steering system of the class comprising a steering member movable to exert a steering effect, rotatable means responsive to rotation thereof for moving said steering member to produce said steering effect, and manually-operable steering control means for effecting control of the rotation of said rotatable means in response to changes in the position of said steering control means, the improvement comprising:

motor means;

double-acting free-wheeling clutch means;

said clutch means comprising primary drive means, free wheel means, and releasable coupling means for rendering said primary drive means responsive to rotational drive applied thereto in either direction to rotate said free wheel means, and for rendering said free wheel means rotatable substantially free of said primary drive means in either direction with respect to said primary drive means;

means connecting said free wheel means to said manually-operable steering control means and to said rotatable means to provide a direct rotational connection between them; and means connecting said motor means to said primary drive means to drive it in rotation when said motor means is operating;

whereby both said motor means and said manually-operable steering control means are drivingly connected to said rotatable means except at times when said free wheel means is rotated with respect to said primary drive means, said steering control means at said times being operable to drive said rotatable means substantially independently of said motor means.

2. The system of claim 1, comprising a linearly-movable element connected to said steering member for moving it to exert steering effect, said rotatable means comprising screw-threaded means associated with said linearly-movable element so as to move it linearly in response to rotation of said screw-threaded means.

3. The system of claim 1, wherein said means connecting said free wheel means to said steering control means comprises a rotatable flexible shaft.

4. The system of claim 1, comprising means responsive to operation of said manually-operable steering control means for controlling the starting, stopping, and direction of rotation of said motor means so as to enable control of said steering effect by said steering control means.

5. The system of claim 1, comprising electric pole changing spring contact means associated with said manually-operable steering control means and electrically connected to said motor means, and responsive to application of more than a predetermined force to said steering control means in either of two directions to operate said motor means in repectively opposite directions.

6. The system of claim 5, comprising additional manually-operable steering control means and connections thereto for controlling starting, stopping and direction of rotation of said motor means.

7. The system of claim 6, comprising switch means for enabling connection and disconnection of said additional steering control means to and from said system.

8. The system of claim 1, comprising automatic steering apparaus operatively connectable to said motor means for controlling said steering effect.

9. The system of claim 8, comprising means for disconnecting said manually-operable steering control means from said clutch means when said automatic steering apparatus is operatively connected to said system.

* * * * *